United States Patent [19]

Thompson et al.

[11] Patent Number: 5,023,978

[45] Date of Patent: Jun. 18, 1991

[54] SCARF CLIP ADAPTER FOR BROOCH OR EARRING

[75] Inventors: Bobbie J. Thompson, Charlottesville, Va.; Tamela T. Thompson, 34 Canterbury Rd., Charlottesville, Va. 22901

[73] Assignee: Tamela T. Thompson, Charlottesville, Va.

[21] Appl. No.: 376,832

[22] Filed: Jul. 7, 1989

[51] Int. Cl.[5] ..... A41F 1/00; A44B 21/00

[52] U.S. Cl. ..... 24/3 L; 24/6; 24/707

[58] Field of Search ..... 24/3 R, 3 L, 3 J, 5, 24/6, 7, 8, 49 R, 49 K, 49 CP, 49 KC, 706.9, 707, 707.9

[56] References Cited

U.S. PATENT DOCUMENTS

| | | | |
|---|---|---|---|
| 546,989 | 10/1895 | Baker, Jr. | 24/707 |
| 547,575 | 10/1895 | Lutters | 24/49 R |
| 609,061 | 8/1898 | Waymack | 24/706.9 |
| 726,975 | 5/1903 | Neithercott | 24/6 |
| 881,622 | 3/1908 | Rosenbaum | 24/707 |
| 1,174,079 | 3/1916 | McKellar | 24/707.9 |
| 2,075,728 | 3/1937 | Kayn | 24/5 |
| 2,141,402 | 12/1938 | Muller | 24/5 |
| 2,358,262 | 9/1944 | Suess | 24/3 L |
| 2,500,114 | 3/1950 | Bowder | 24/49 CP |

FOREIGN PATENT DOCUMENTS

| | | | |
|---|---|---|---|
| 0025552 | of 1912 | United Kingdom | 24/3 R |

*Primary Examiner*—Victor N. Sakran

*Attorney, Agent, or Firm*—W. Brown Morton, Jr.

[57] ABSTRACT

A neckerchief clip adapter is disclosed comprising a front, generally-planar member fastened by a hinge to the rear member, also generally planar. The rear member has a large opening therethrough to accommodate the ends of the neckerchief with which it is to be worn in the usual manner. The hinge structure attaching front and rear members to each other includes a flange-and-lug camming mechanism which allows the two members to pivot freely over the "open" part of their relative movement but provides a spring force urging them together over the "closed" part thereof. According to the invention the rear surface of the front member carries a mounting element for the conveniently-removable attachment of an ornament to adorn the front surface of that member and thereby the neckerchief with which it is worn. In the preferred embodiments, this mounting is generally tubular and sponge-filled, parallel to the plane of the front member for accommodating and retaining the stem of a brooch, but perpendicular to it for accommodating and retaining the post of a pierced earring.

6 Claims, 1 Drawing Sheet

SCARF CLIP ADAPTER FOR BROOCH OR EARRING

BACKGROUND OF THE INVENTION

In the wearing of neckerchiefs, that is to say scarves or kerchiefs about the neck, the front ends are often fed through rings or grommets instead of knotting them. They are often specially formed and decorated for improved appearance. Such a ring may be provided with a pivoted front facing "clip" member which is itself of decorative shape or finish and assists in retaining a place on the scarf. Heretofore, a plurality of such clips were required to provide a variety in the ornamentation afforded.

FIELD OF THE INVENTION

This invention relates to a simple adaptation of a scarf clip to permit it to be adorned with a virtually unlimited variety by removably attaching thereto pre-existing ornaments, especially brooches or earrings.

DESCRIPTION OF THE PRIOR ART

The prior art discloses a variety of rings and grommets retaining the front ends of neckerchiefs, as by various scouting groups and naval personnel. All sorts of integral and applied decorations have been used to adorn such rings and grommets. Rings have even been provided with front ornamental clip members fastened thereto that also serve to improve their hold on the scarf ends. No one heretofore has suggested to provide such front clip members with mounting elements so that existing ornaments can be conveniently removably fastened to them.

SUMMARY

The invention is especially desirable as an adjunct to feminine fashion providing a scarf clip adapter which permits the scarf wearer to vary the ornamentation of its holder ring as widely as the range of her stock of brooches (or pins) and pierced earrings permits. This function is provided in the preferred embodiments by a tubular mounting carried on the back surface of the front planar clip member. This mounting is oriented to be parallel to the plane of that member to accommodate the stem or pin of a brooch and perpendicular to that plane to accommodate the post of a pierced earring. The tube of the mounting is advantageously filled with a penetrable retaining medium, e. g., plastic sponge.

DETAILED DESCRIPTION

Figure 1:
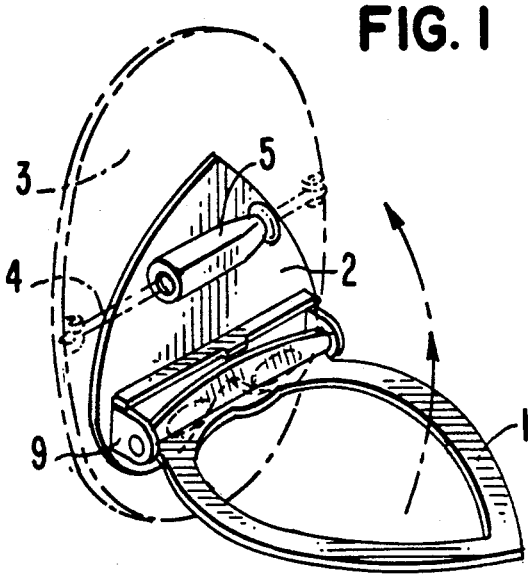
FIG. 1 is a perspective view from the rear of a clip adapter in the hinge-open setting in the form to be adorned with a brooch.
Figure 5:
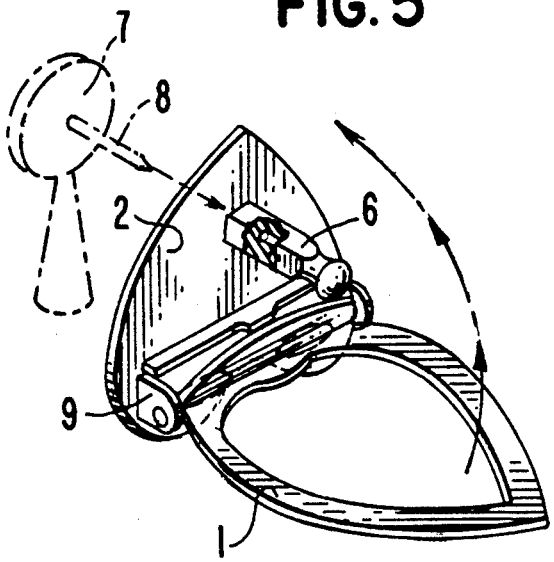
FIG. 5 is a perspective view corresponding to FIG. 1, but in the form to be adorned with a pierced earring.

As shown in FIGS. 1 and 5, the neckerchief clip adapter of our invention consist of two pianar members, hinged together like a door hinge. The rear member 1 effectively a ring through which the neckerchief ends are to be threaded. The front member 2 is a flat plate shaped and finished to be pleasing in appearance of itself. The heart-shaped outline of members 1 and 2 is incidental and for appearance only.

Figure 2:
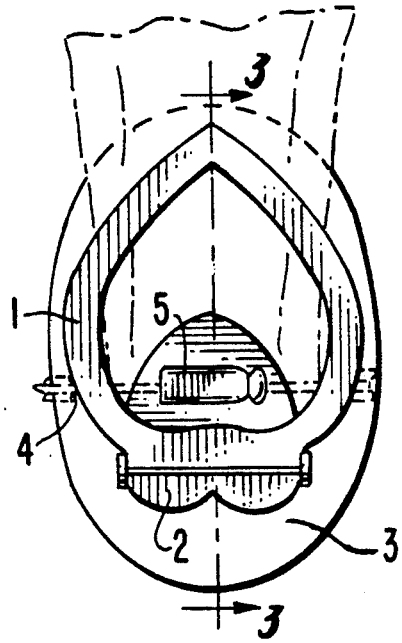
FIG. 2 is a rear elevation of the adapter shown in FIG. 1 in the hinge-closed setting.
Figure 3:
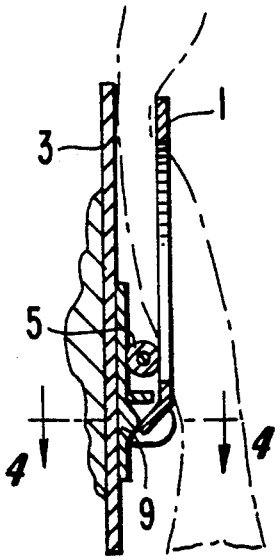
FIG. 3 is a section taken on the line 3—3 of FIG. 2.

As shown in FIGS. 1, 2, and 3, the adapter of our invention is being used to display a brooch 3 over the front surface of front member 2 by passing the shaft of its stem or pin 4 through the bore of tubular mounting fixture 5 carried by the rear surface of member 2 parallel to the plane thereof. Bore of fixture 5 is preferably packed with a penetrable retaining medium, e.g., plastic foam.

As shown in FIG. 5, the adapter of our invention is being used to display a pierced earring 7 over the front surface of front member 2 by passing its post 8 into the bore of tubular mounting fixture 6 carried by the rear surface of member 2 perpendicular to the plane thereof. The post 8 passes through a hole in member 2 from the front surface thereof and is retained in fixture 6 by a penetrable retaining medium filling its bore.

Figure 4:
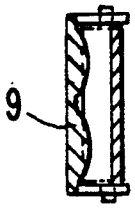
FIG. 4 is a section taken on the line 4—4 of FIG. 3.

A camming detent device is a part of hinge structure 9, as particularly shown in FIGS. 3 and 4. A scarf 10 is indicated in FIGS. 2 and 3 for clarity of understanding of the manner of using our adapter therewith.

We claim:

1. A neckerchief clip adapter having, as the neckerchief-ends-encircling member, a generally-planar rear element through which said ends are threaded from above downward and from front to rear and which carries one portion of a hinge and a generally-planar front display element which carries the other portion of said hinge, pivotally hinged it to said rear element to engage said ends between said elements, and including a mounting fixture having a tubular bore carried by said front element adapted to retain and display, when attached thereto, a separately usable ornament.

2. An adapter according to claim 1 wherein the axis of the bore is parallel to the plane of the front element.

3. An adapter according to claim 1 wherein the axis of the bore is perpendicular to the plane of the front element.

4. An adapter according to claim 3 wherein the mounting fixture is on the rear surface of the front element and there is an opening from the bore through said element to the front surface thereof.

5. An adapter according to claim 1 wherein the mounting tube bore is packed with a penetrable retaining substance.

6. A neckerchief clip adapter having, as the neckerchief-ends-encircling member, a generally-planar rear element through which said ends are threaded from above downward and from front to rear which carries one portion of a hinge and a generally-planar front display element which carries the other portion of said hinge, pivotally hinged to said rear element to engage said ends between said elements, and a mounting fixture carried by said front element adapted to retain attached thereto an independent and separately usable ornament.

* * * * *